US010779591B2

(12) United States Patent
Insabella-Sabo

(10) Patent No.: US 10,779,591 B2
(45) Date of Patent: Sep. 22, 2020

(54) BURP CLOTH BOTTLE HOLDER

(71) Applicant: Nicole Topaz Insabella-Sabo, Schnecksville, PA (US)

(72) Inventor: Nicole Topaz Insabella-Sabo, Schnecksville, PA (US)

(73) Assignee: Nicole T. Insabella-Sabo, Schnecksville, PA (US)

( * ) Notice: Subject to any disclaimer, the term of this patent is extended or adjusted under 35 U.S.C. 154(b) by 74 days.

(21) Appl. No.: 16/350,771

(22) Filed: Jan. 7, 2019

(65) Prior Publication Data

US 2020/0214375 A1 Jul. 9, 2020

(51) Int. Cl.

| | |
|---|---|
| ***A41D 27/00*** | (2006.01) |
| ***A41D 27/12*** | (2006.01) |
| ***A41D 27/20*** | (2006.01) |

(52) U.S. Cl.

CPC ..... *A41D 27/12* (2013.01); *A41D 27/207* (2013.01); *A41D 2400/80* (2013.01)

(58) Field of Classification Search

CPC ... A41D 27/12; A41D 27/207; A41D 2400/80
See application file for complete search history.

(56) References Cited

U.S. PATENT DOCUMENTS

| | | | | | |
|---|---|---|---|---|---|
| 2,617,105 | A * | 11/1952 | Backman | A41D 1/215 | 2/48 |
| 2,672,263 | A * | 3/1954 | Frieda | A45F 5/00 | 224/602 |
| 2,831,193 | A * | 4/1958 | Terry | A41B 13/10 | 2/46 |
| 5,008,960 | A * | 4/1991 | Hemming | A41D 1/215 | 2/104 |
| D350,435 | S * | 9/1994 | Smith, IV | D3/231 | |
| D408,138 | S * | 4/1999 | Mracna | D3/261 | |
| 6,588,023 | B1 * | 7/2003 | Wright | F41C 23/08 | 2/459 |
| 7,048,160 | B2 * | 5/2006 | Anderson | A47D 13/02 | 224/148.6 |
| 7,316,035 | B2 * | 1/2008 | Archambault | A41B 13/00 | 2/46 |
| 8,915,408 | B1 * | 12/2014 | Hill | A61J 9/0638 | 224/148.4 |

* cited by examiner

*Primary Examiner* — Steven O Douglas

(57) ABSTRACT

One embodiment is a flat body of material having a diagonal front pocket and opposing back pocket containing a secured counter weight. The open front pocket is internally lined with grip fabric. The pocket with grip liner enables the operator to hold the bottle securely in place. The slanted base of the front pocket holds the bottle at a comfortable angle to feed the infant. Within the longest portion of the material, there is an indent for shoulder placement. In addition, the back pocket is draped over the operator's back with a secured counter weight at the base of the pocket. The envelope flap of the back pocket covers the opening to the pocket.

3 Claims, 3 Drawing Sheets

BURP CLOTH BOTTLE HOLDER

CROSS-REFERENCE TO RELATED APPLICATIONS

This application claims the benefit of provisional patent application Ser. No. 62/709,100, filed 2018 Jan. 8 by the present inventor.

BACKGROUND—PRIOR ART

The following is a tabulation of some prior art:

| U.S. Patent Application Publications | | | |
|---|---|---|---|
| Publication Nr. | Publ. Date | Applicant | Name |
| U.S. 10/744,981 | 2003 Dec. 22 | Archambault | Multi Purpose Burp Cloth |
| U.S. 10/374,360 | 2003 Feb. 25 | Anderson | Infant Feeding and Entertainment Support |
| U.S. 29/510,698 | 2014 Dec. 2 | Hill | Baby Bottle Holder for Feeding a Baby |

The ability to complete multiple tasks at one time is a necessity in today's hectic environment. Oftentimes while feeding a baby, the caregiver is unable to do anything else, as his or her hands are both being utilized by feeding the infant. If there are other children in the household to care for, this scenario becomes increasingly difficult. Allowing for a free hand to tend to other tasks is an understated advantage in our modern day, chaotic lifestyle. Simplicity and quick convenience is of incredible importance when caring for an infant.

Several types of bottle holders have been proposed—for example, publication number U.S. Ser. No. 10/744,891 to Archembault. Although this design allows for multitasking and hands free bottle feeding, such design holds a bottle with a thin strap which provides minimal security of the bottle and allows it to slide out. Another example is publication number U.S. Ser. No. 10/374,360 to Anderson. Although this design also serves multiple uses, it is awkward and not user friendly. There appear to be a number of attachments and devices that would pose as cumbersome while trying to feed a cranky infant. Lastly, the example of publication number U.S. Ser. No. 29/510,698 to Hill allows for hands free feeding, yet only serves one use and takes up a great deal of storage in a diaper bag. All of the bottle holders described above suffer from a number of disadvantages:

(a) They do not securely encompass a majority of the bottle which can pose as a safety risk to the infant. As in the first example, the thin strap does not appear to contain any kind of material to grip the bottle in place, which could easily allow the bottle to slide out of position and injure the infant.

(b) The many uses of the first two examples can detract from the ease of use for the operator. When caring for a hungry infant, simplicity is a key, important factor for the caregiver to ease a frustrating situation.

(c) Bottle holders composed of plastic and other materials can be difficult to clean, and serve only one use.

(d) All of the examples listed above appear to take up a significant amount of space in a diaper bag. In a bag that oftentimes is transported everywhere, only the most important items are awarded space within the diaper bag.

SUMMARY

In accordance with one embodiment, a burp cloth comprising a flat body of flexible material having a diagonal pocket lined with grip liner and opposing pocket containing counter weight.

Advantages

Accordingly several advantages of one or more aspects are as follows: to provide a bottle holder that securely and efficiently holds a bottle for a feeding infant, that allows for hands free bottle feeding for the operator, that can be easily manufactured in color with designs, that can function as a burp cloth, that is machine washable and can be easily stored for convenience and quick access in a diaper bag. Other advantages of one or more aspects will be apparent from a consideration of the drawings and ensuing description.

DRAWINGS—REFERENCE NUMBERS

| | | | |
|---|---|---|---|
| 10 | opening of front pocket | 12 | grip liner |
| 14 | slanted base of pocket | 16 | indent for shoulder placement |
| 18 | back pocket | 20 | envelope flap |
| 22 | stitched in counter weight | 24 | flexible material |
| 26 | burp cloth rolled into back pocket | | |

DETAILED DESCRIPTION OF THE INVENTION

Figure 1:
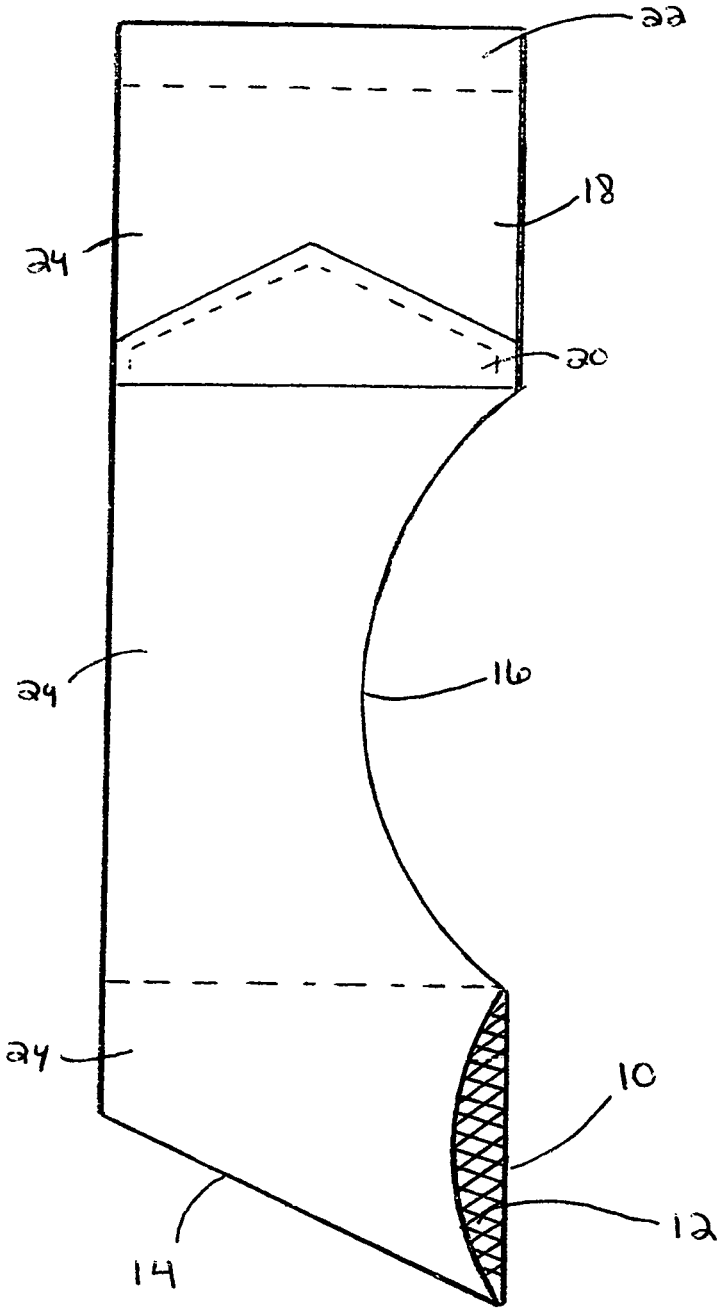
FIG. 1 is a view of the main body of the burp cloth, and showing the features described herein.
Figure 2:
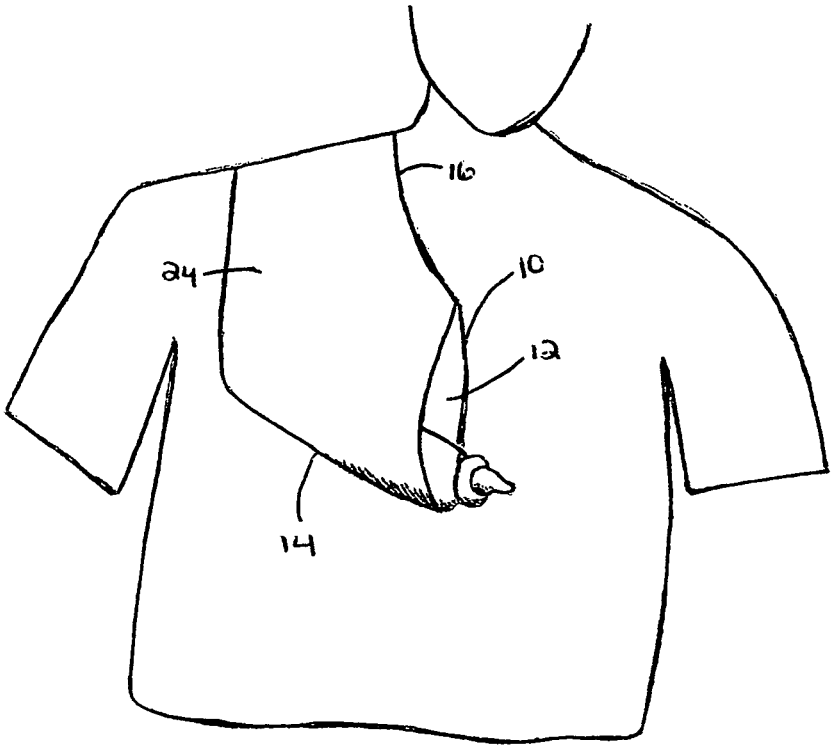
FIG. 2 is a perspective view of the front of the burp cloth in use by the operator.

One embodiment of the burp cloth bottle holder is illustrated in FIG. 1 (top view) and FIG. 2 (perspective view). The burp cloth bottle holder is constructed of flexible material 24 and is about 27 inches long to the right side, and about 23 inches long to the left side. The burp cloth has an open front pocket 10. The opening measures about 6¾ inches long and is internally lined with grip liner 12, such as grip fabric liner. The internally lined grip fabric 12 enables the operator to securely hold the bottle holding up to 8 oz of liquid securely in place. The slanted base of the front pocket 14 is about 8½ inches long and holds the bottle at roughly a 30 degree angle for easy feeding of the infant. Within the longest portion of the material, there is an indent that measures roughly 4 inches wide for shoulder placement 16.

The back pocket 18, measuring about 8 inches long by 7 inches wide is draped over the operator's back. The stitched in counter weight 22 is at the base of the pocket keeping it securely in place. The envelope flap 20 of the back pocket 18 covers the opening to the pocket. Persons skilled in the art will understand that the counter weight may be secured by many other means besides stitching, including but not limited to Velcro, glue and magnetism.

Figure 3:
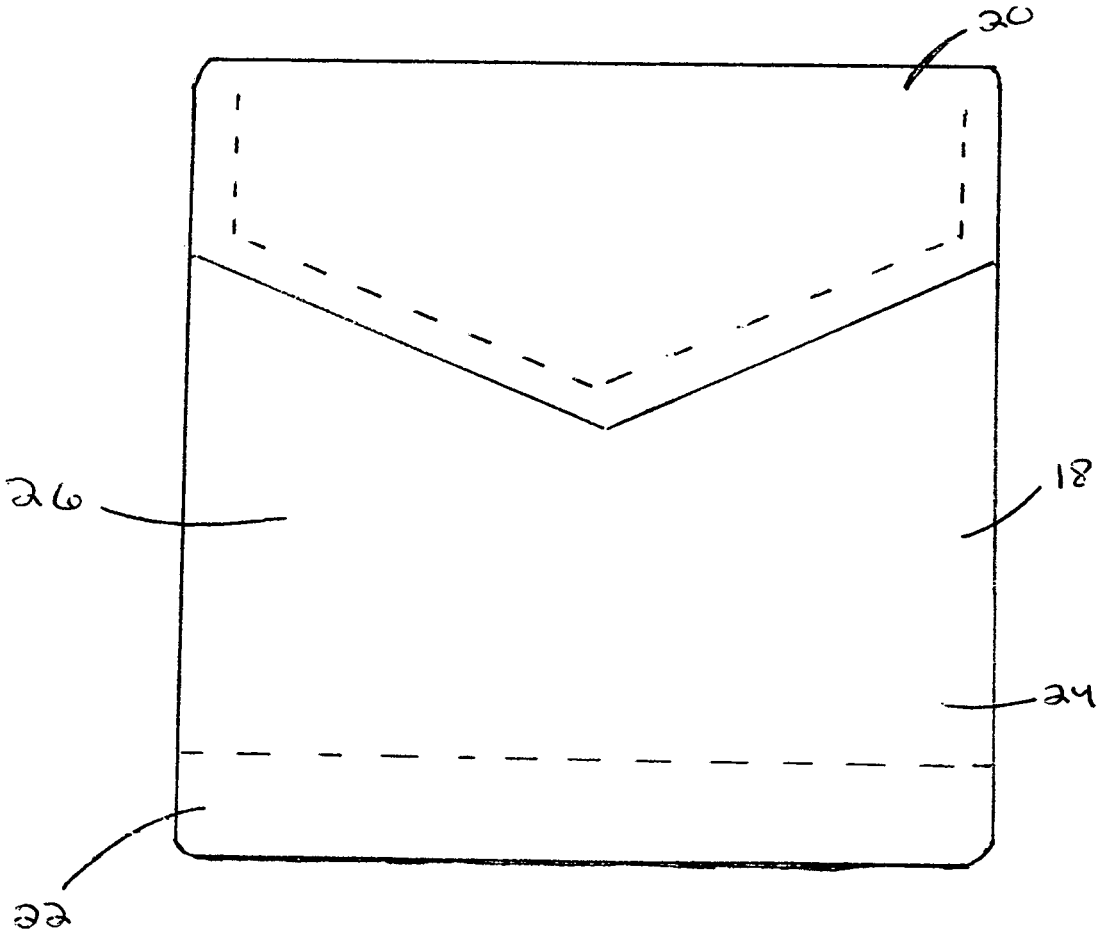
FIG. 3 is a perspective view of the burp cloth rolled into the back pocket when not in use.

Operations—FIGS. 1, 2 and 3

The manner of using the burp cloth bottle holder is to unroll, unfold or remove from the back pocket 26 and drape over the operator's dominant shoulder. Example for a right handed user is to drape the burp cloth at the indent 16 over the right shoulder, with the large opening to the front pocket 10 facing to the operator's left. While cradling the infant in the left arm, temporarily tilt the opening of the front pocket 10 upwards while inserting the body of the bottle (base down) into the pocket lined with grip liner 12. The grip liner will secure the bottle as the opening of the front pocket 10 is brought downwards into the correct position. The slanted base of the pocket 14 will hold the bottle in place at about a downward facing 30 degree angle. The stitched in counter weight 22 at the base of the back pocket 18 will provide a resistant counter weight to the weight of the bottle in the front pocket 10. When the infant is finished feeding, simply tilt the opening of the front pocket 10 upwards to slide the bottle out of the pocket. Burp the baby as in the manner of using any other burp cloth.

FIG. 3—Additional Embodiments

Additional embodiments are shown in FIG. 3 (perspective view) wherein said burp cloth bottle holder is rolled into back pocket 26 for storage when not in use. The back pocket 18 is turned inside out and the burp cloth is rolled inside. This allows the operator to neatly store this item in the diaper bag when not in use.

Advantages

From the description above, a number of advantages of some embodiments of my burp cloth bottle holder become evident:

(a) The grip lined front pocket holds the bottle safely and securely in place to feed an infant without risk of sliding out and injuring the baby.

(b) The slanted base of the front pocket holds the bottle at a comfortable angle for easy feeding of the infant.

(c) The overall length of the burp cloth bottle holder and the counter weight in the back pocket create a balance to independently hold the bottle for the infant. This allows the operator hands free use.

(d) The indent for shoulder placement allows for comfort for the operator when in use.

(e) The flexible material, preferably a soft material, of the body of the burp cloth provides comfort to both the infant and the operator while in use.

(f) The simple and effective design allows for quick ease of use to the operator while caring for an infant.

(g) The multiple uses of this one object allow the operator to use it as a bottle holder as well as a burp cloth.

(h) The burp cloth bottle holder is machine washable and can be dried in a dryer on low without risking damage to the garment.

(i) The pocket can be rolled inside out to contain the burp cloth for easy storage in the diaper bag.

(j) The burp cloth bottle holder provides the operator freedom of the use of his or her hands.

Accordingly, the reader will see that the burp cloth bottle holder can be used quickly and easily while caring for an infant. The pocket lined with grip liner securely holds the bottle in place to ensure the safety of the infant. It uses minimal space in the diaper bag when not in use, allowing space for other everyday necessities. It provides the operator the freedom to use his or her hands while feeding an infant. It is also easily cleaned as it is machine washable.

Furthermore, the burp cloth bottle holder has the additional advantages in that:

- It permits production in a variety of colors and patterns without additional requirements to the manufacturer.
- The burp cloth bottle holder's simple design aids in the ease of manufacturing.
- It provides a location on the surface of the front pocket to place a product logo.
- It may be constructed from fabric that is soft yet durable and highly absorbent.

Although the description above contains much specificity, these should not be construed as limiting the scope of the embodiments, yet providing illustrations of some several embodiments. For example, the back pocket may vary in size as could the front pocket.

Thus the scope of the embodiments should be determined by the appended claims as well as their legal equivalents, rather than by the examples given.

I claim:

1. A burp cloth bottle holder comprising a flat body of a material having a diagonal pocket of the width of the burp cloth defining an elongated opening on one side and a closed smaller end on an opposite side that are connected by a diagonally arranged stitch defining a slanted base to support a bottle in a tilted orientation, an opposing pocket including an envelope shaped flap arranged for containing a counter weight and an indent of reduced width disposed between the diagonal pocket and the opposing pocket so as to facilitate placement of the blurp cloth on a shoulder of a user, wherein the diagonal pocket and the opposing pocket containing the counter weight allow for hands free bottle feeding of an infant.

2. The burp cloth bottle holder of claim 1, wherein the flat body is internally lined with a grip liner.

3. The burp cloth bottle holder of claim 1, wherein the counter weight is stitched into a bottom of the posing pocket.

* * * * *